US005702334A

United States Patent [19]

Lee

[11] Patent Number: 5,702,334

[45] Date of Patent: Dec. 30, 1997

[54] ABDOMEN FITNESS EQUIPMENT

[76] Inventor: Chi-Jung Lee, No. 61, May Chou II Rd., I Lan City, I Lan Hsien, Taiwan

[21] Appl. No.: 716,735

[22] Filed: Sep. 23, 1996

[51] Int. Cl.[6] ..... A63B 23/02

[52] U.S. Cl. ..... 482/140; 482/95; 482/131; 482/142

[58] Field of Search ..... 482/72, 92, 95, 482/96, 121–123, 129–133, 135–140, 142, 148, 908; 297/68, 75, 90, 91; 601/23, 24, 26

[56] References Cited

U.S. PATENT DOCUMENTS

| | | | |
|---|---|---|---|
| D. 349,344 | 8/1994 | Kudlak | D21/191 |
| 5,545,114 | 8/1996 | Gvoich | 482/140 |
| 5,575,741 | 11/1996 | Fan | 482/72 |
| 5,599,261 | 2/1997 | Easley et al. | 482/140 |
| 5,601,519 | 2/1997 | Comereski | 601/24 |
| 5,626,542 | 5/1997 | Dalebout et al. | 482/72 |

*Primary Examiner*—Jeanne M. Clark
*Attorney, Agent, or Firm*—Varndell Legal Group

[57] ABSTRACT

An abdomen fitness equipment including a front base frame unit carrying a cushion, a substantially U-shaped handle fixed to the front end of the front base frame unit for pulling, a rear base frame unit pivoted to the rear end of the front base frame unit, a movable frame unit pivoted to the front end of the rear base frame unit, and a movable leg frame unit pivoted to the rear end of the rear base frame unit, the movable leg frame unit having an adjustable extension rod equipped with a pulley, the pulley being moved along a longitudinal rod in the rear base frame unit when the movable leg frame unit is pulled with the legs to lift the movable frame unit.

1 Claim, 8 Drawing Sheets

ABDOMEN FITNESS EQUIPMENT

BACKGROUND AND SUMMARY OF THE INVENTION

The present invention relates to a abdomen fitness eqipment, and relates more particularly to such an abdomen fitness equipment which can efficiently exercise the muscles of the abdomen with less effort and, which is simple in structure.

FIG. 1 shows an abdomen fitness equipment according to the prior art. This structure of abdomen fitness equipment is functional in exercising the muscles of the abdomen. However, it still has drawbacks. When the user's legs are hooked on the transverse leg bar of the movable leg frame unit and pulled to lift the frame rod and seat of the rear movable frame unit from the rear base frame unit, much effort should be employed to the legs. Another drawback of this structure of abdomen fitness equipment is that the movable leg frame unit can only be oscillated within a limited angle. Because the movable leg frame unit can only be oscillated within a limited angle, the abdomen exercising efficiency is low. Furthermore, the movable frame unit and the rear base frame unit are complicated in structure.

According to one aspect of the present invention, the abdomen fitness equipment comprises a front base frame unit carrying a cushion, a substantially U-shaped handle fixed to the front end of the front base frame unit for pulling, a rear base frame unit pivoted to the rear end of the front base frame unit, a movable frame unit pivoted to the front end of the rear base frame unit, and a movable leg frame unit pivoted to the rear end of the rear base frame unit, the movable leg frame unit having an adjustable extension rod equipped with a pulley, wherein the pulley is moved along a longitudinal rod in the rear base frame unit when the movable leg frame unit is pulled with the legs to lift the movable frame unit. According to another aspect of the present invention, the extension rod of the movable leg frame unit has a longitudinal series of locating holes adjustable connected to the base frame rod of the movable leg frame unit. Therefore, by changing the connection between the base frame rod and the extension to adjust the combined length thereof, the maximum lifting angle of the movable frame unit is adjusted. According to still another aspect of the present invention, the pulley of the movable leg frame unit has two locating plates at two opposite sides adapted for guiding the movement of the pulley along the longitudinal rod of the rear base frame unit.

DETAILED DESCRIPTION OF THE PREFERRED EMBODIMENT

Figure 1:
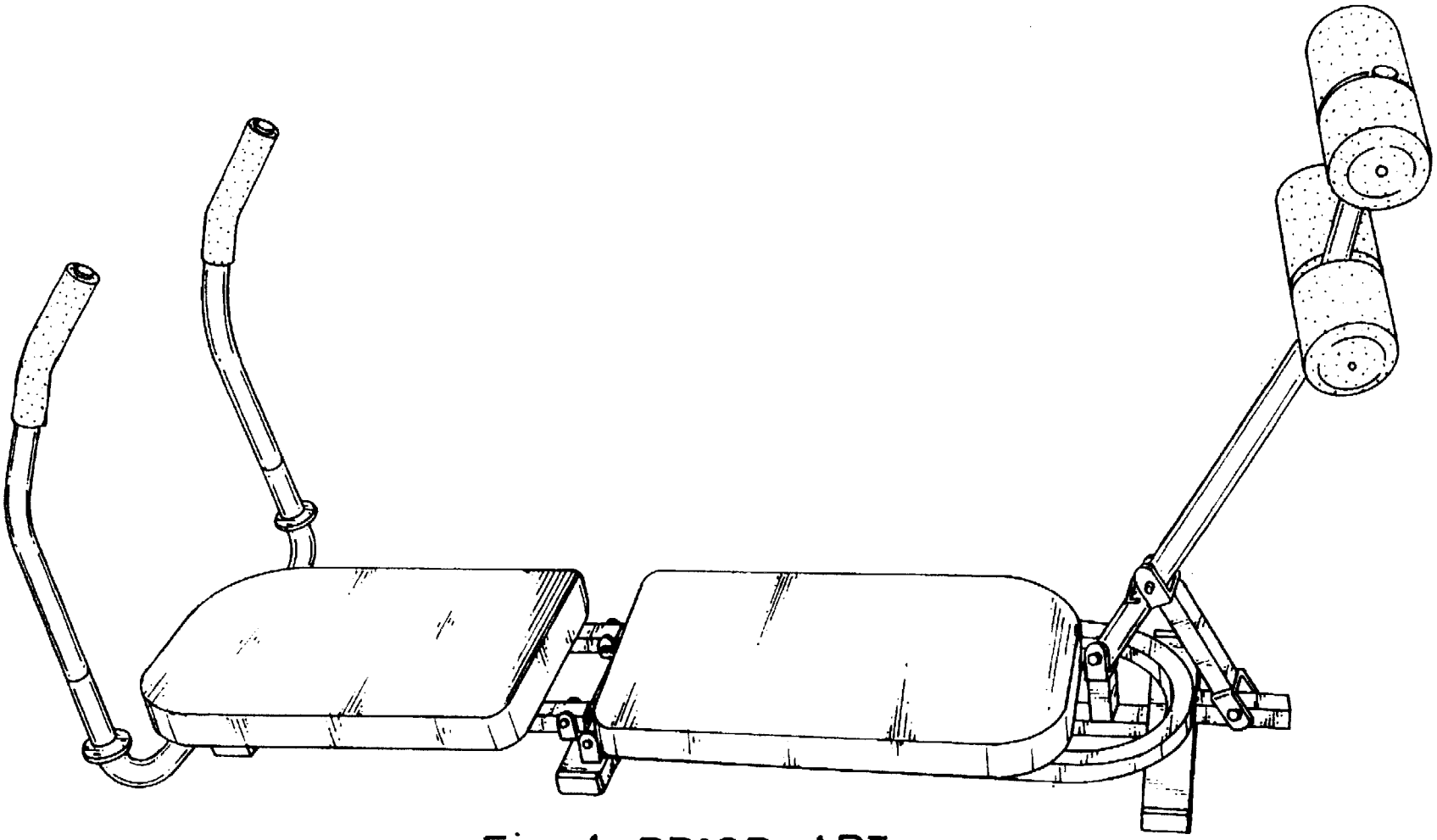
Fig. 1 PRIOR ART
FIG. 1 is an elevational view of an abdomen fitness equipment according to the prior art.
Figure 2:
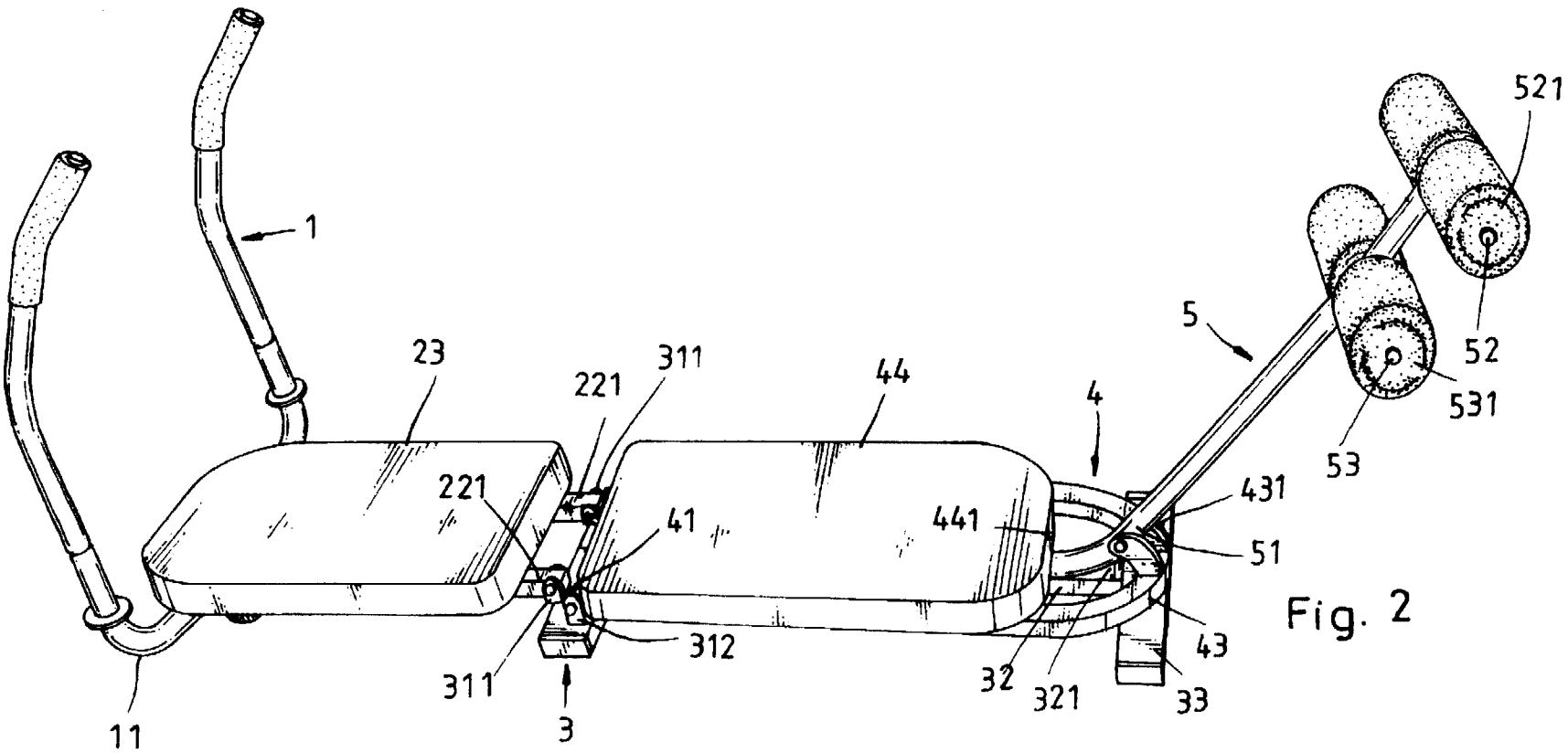
FIG. 2 is an elevational view of an abdomen fitness equipment according to the present invention.
Figure 3:
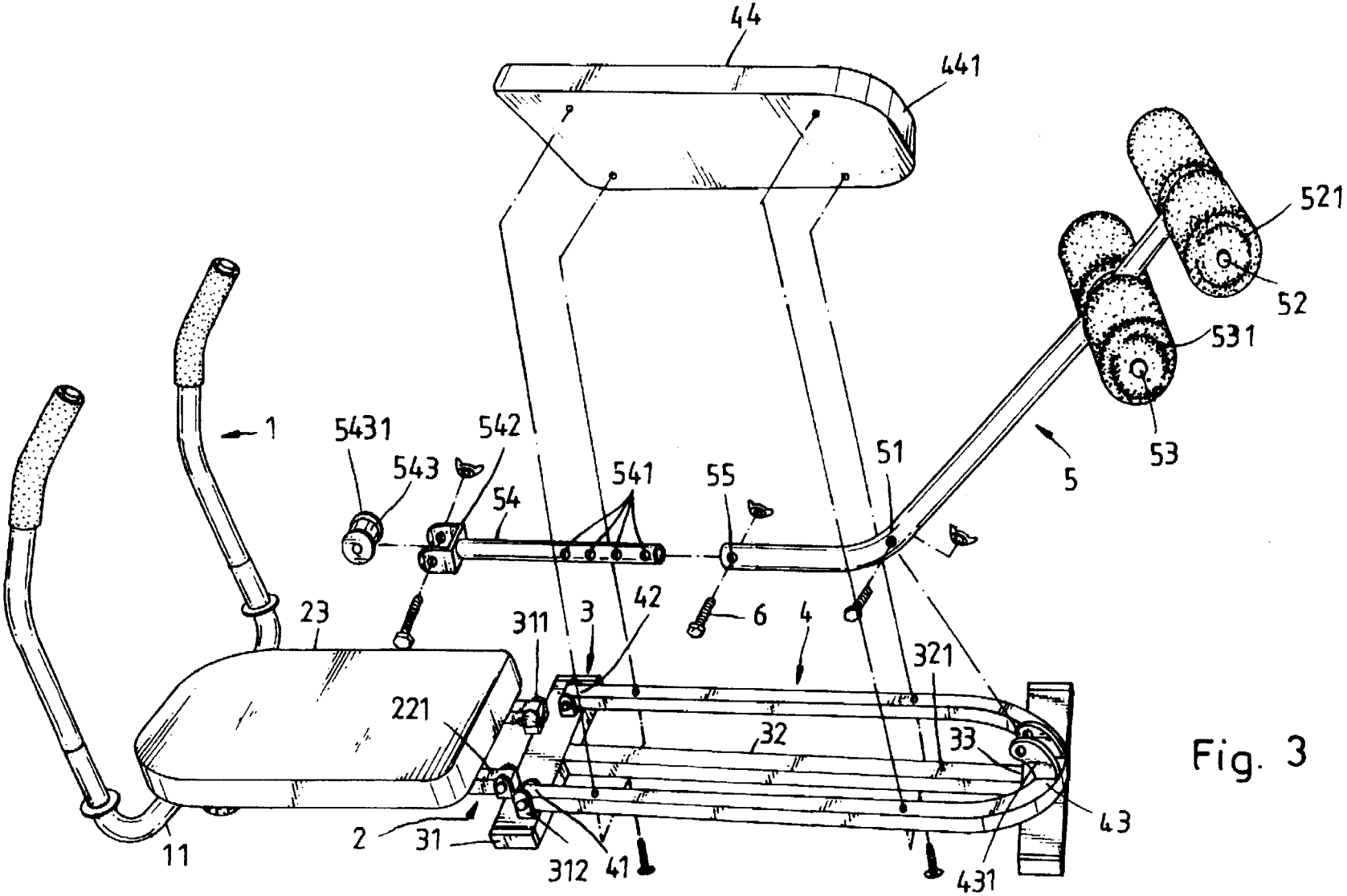
FIG. 3 is an exploded view of the abdomen fitness equipment shown in FIG. 2.
Figure 4:
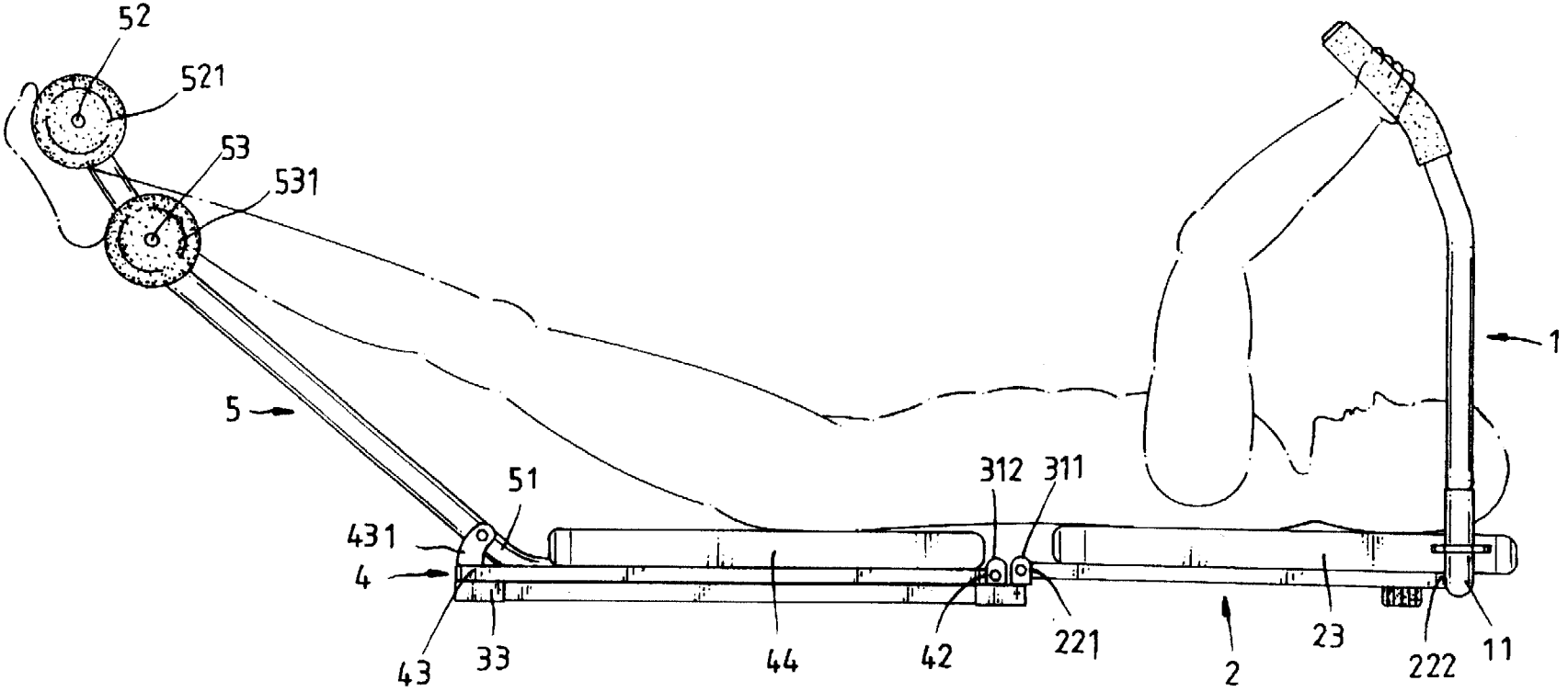
FIG. 4 is a side view of the abdomen fitness equipment shown in FIG. 2.

Referring to FIGS. from 2 to 8, an abdomen fitness equipment in accordance with the present invention is generally comprised of a handle 1, a front base frame unit 2, a rear base frame unit 3, a rear movable frame unit 4, and a movable leg frame unit 5.

The handle 1 has a substantially U-shaped profile, having a middle section 11 fixedly secured to the front base frame unit 2. The front base frame unit 2 comprises two parallel rods 22 longitudinally disposed at two opposite sides, and a cushion 23 fixedly mounted on the parallel rods 22 at the top. The parallel rods 22 have a respective front end 222 fixedly connected to the middle section 11 of the handle 1, and a respective rear end 221 pivoted to the rear base frame unit 3. The rear base frame unit 3 comprises a transverse front end rod 31, a transverse rear end rod 33, a longitudinal rod 32 connected between the transverse front end rod 31 and the transverse rear end rod 33, a first pair of U-frames 311 fixedly and bilaterally mounted on the transverse front end rod 31 at the front side and respectively pivoted to the rear ends 221 of the parallel rods 22 of the front base frame 2, and a second pair of U-frames 312 fixedly and bilaterally mounted on the transverse front end rod 311 near the rear side and respectively pivoted to the rear movable frame unit 4. The rear movable frame unit 4 is made from a substantially U-shaped frame rod having two opposite ends 41 and 42 respectively pivoted to the second pair of U-frames 312 of the rear base frame unit 3, two lugs 431 fixedly secured to the middle section 43 thereof and bilaterally pivoted to the movable leg frame unit 5, and a seat 44 fixedly secured thereto at the top. The seat 44 has a rear end 441 spaced from the middle section 43 of the rear movable frame unit 4 at a distance so that the movable leg frame unit 5 can be inserted through the space defined between the rear end 441 of the seat 44 and the middle section of the rear movable frame unit 4 and pivotably connected between the lugs 431, having two transverse leg bars 52 and 53 at the top, and a locating hole 55 at the bottom end connected to the extension frame rod 54 by a fastening device 6. The transverse leg bars 52 and 53 are covered with a respective rubber covering 521 or 531. The extension frame rod 54 has a longitudinal series of locating holes 541 at one end selectively fastened to the locating hole 55 of the base frame rod 51 by the fastening device 6, a lug 542 at an opposite end, and a pulley 543 mounted on the lug 542 and moved along the top side 321 of the longitudinal rod 32 of the rear base frame unit 3. The pulley 543 has two locating plates 5431 at two opposite sides adapted for guiding the movement of the pulley 543 along the longitudinal rod 32 of the rear base frame unit 3.

Figure 5:
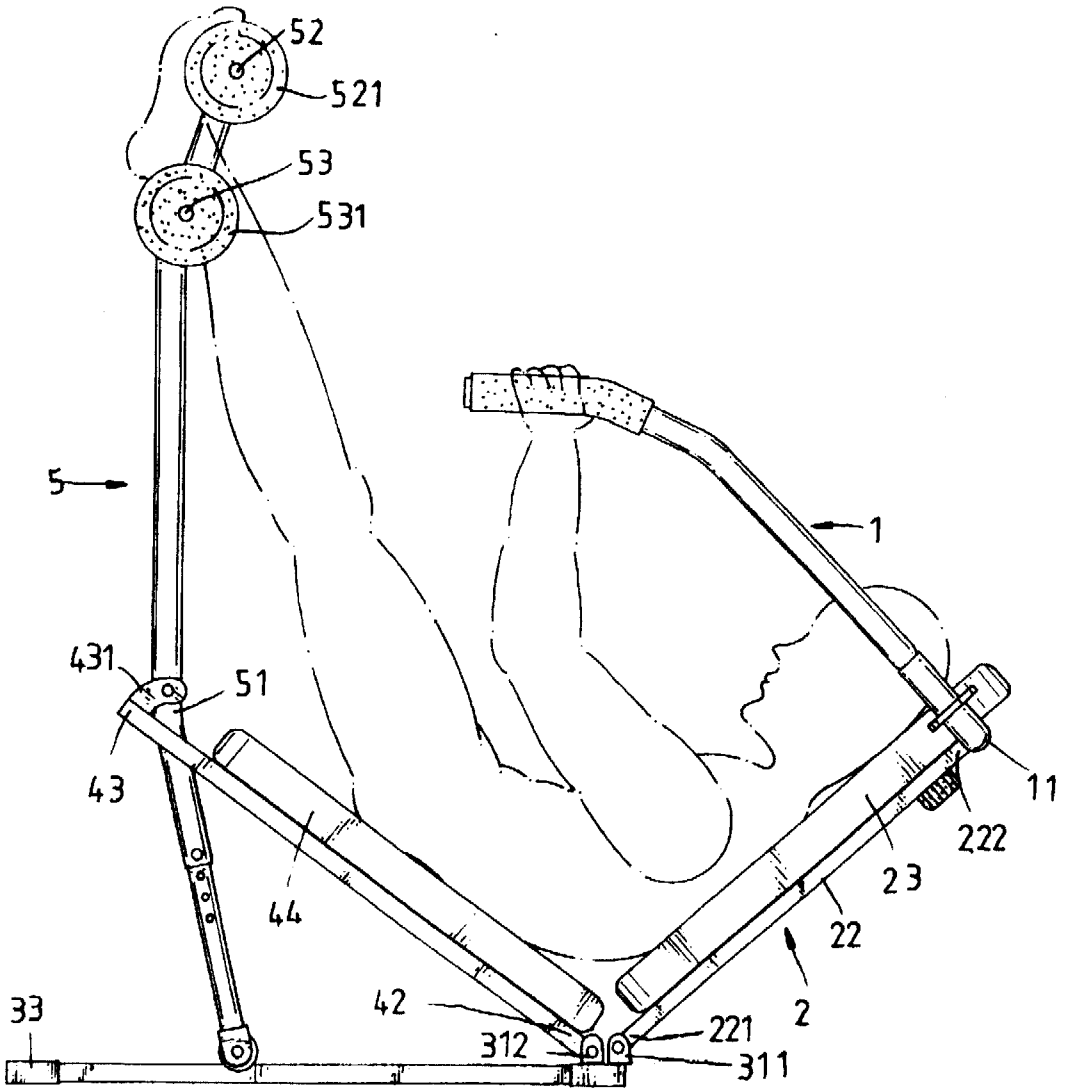
FIG. 5 is an applied view of the present invention, showing the abdomen fitness equipment operated.

Referring to FIG. 5 again, when the user sits on the seat 44, the legs are inserted through the gaps between the transverse leg bars 52 and 53 and then hung thereon, and user's back is supported on the cushion 23, thus the user can pull the handle 1 with the hands and pull the transverse leg bar 52 with the legs to exercise the muscles of the abdomen. When pulling, the pulley 543 is forced to move along the longitudinal rod 32 of the rear base frame unit 3.

Figure 6:
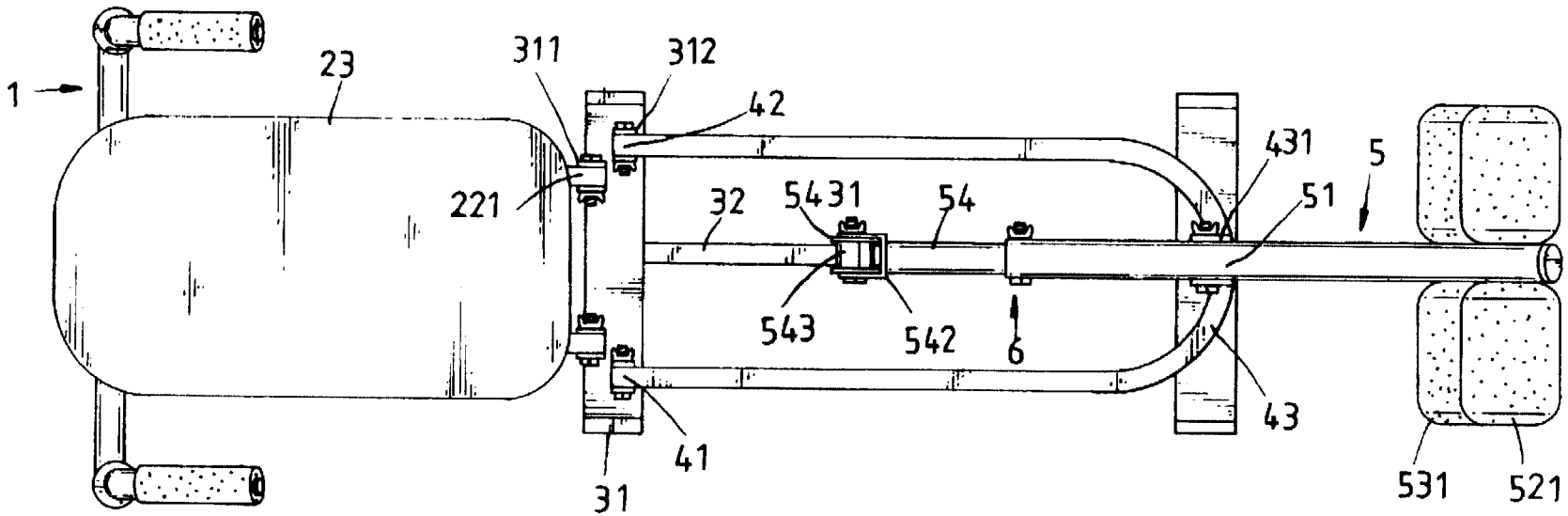
FIG. 6 is a top view of the abdomen fitness equipment shown in FIG. 2 when the seat removed.
Figure 7:
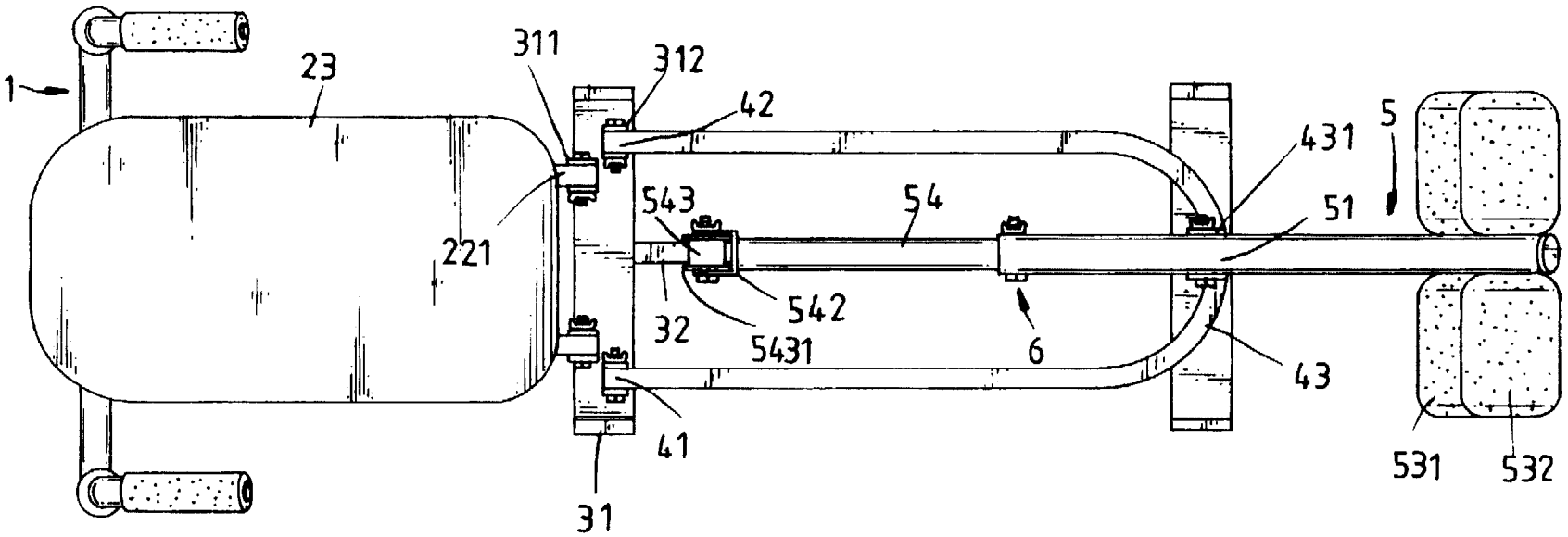
FIG. 7 is similar to FIG. 6 but showing the combined length of the base frame rod and leg frame rod of the movable leg frame unit adjusted.
Figure 8:
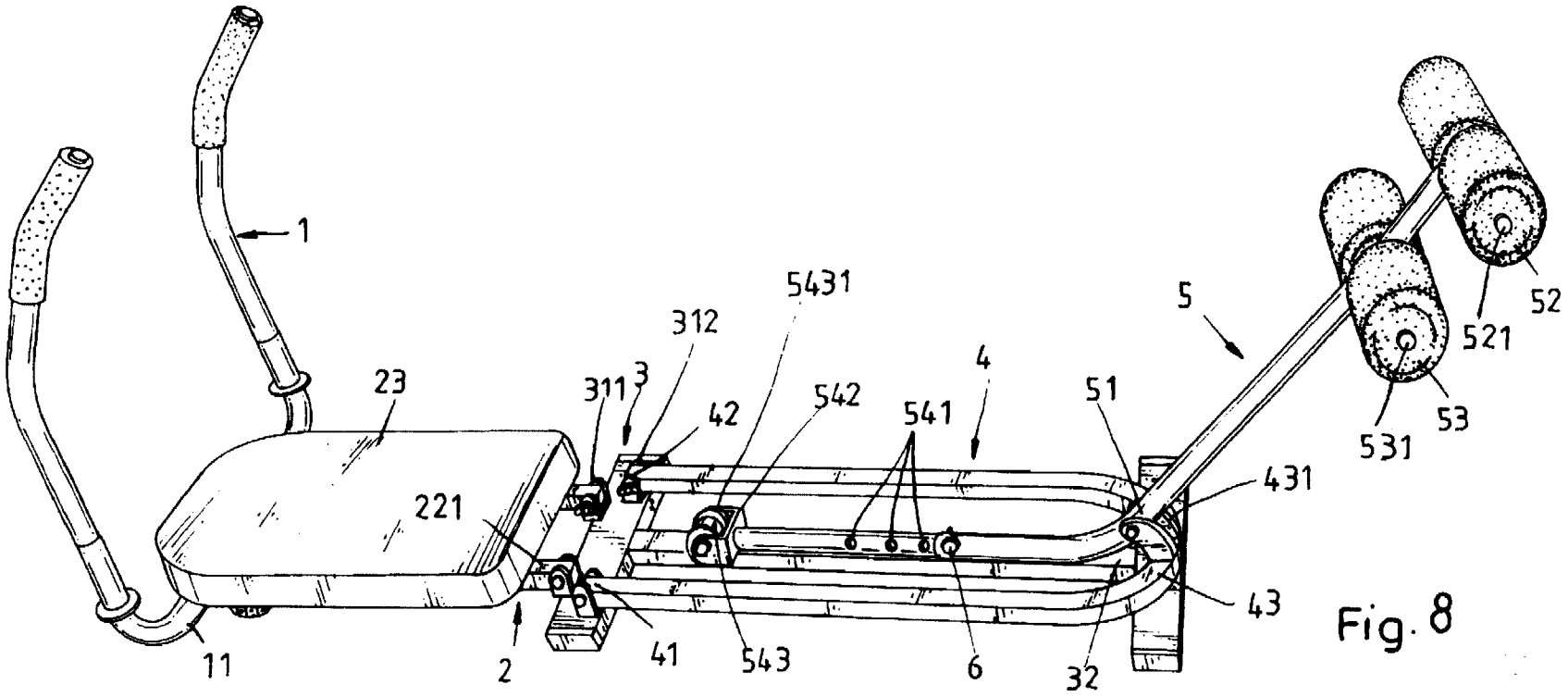
FIG. 8 is another elevational view of the present invention when the seat removed.

Referring to FIGS. 5, 6, and 7 again, the combined length of the base frame rod 51 and the extension frame rod 54 can be adjusted by: loosening the fastening device 6, and then shifting the connection between the locating hole 55 of the base frame rod 51 and the locating holes 541 of the extension frame rod 54. When the combined length of the base frame rod 51 and the extension frame rod 54 is adjusted, the maximum angle of inclination of the movable leg frame unit 5 is relatively adjusted. Because the locating plates 5431 of the pulley 543 are slidably attached to the longitudinal rod 32 of the rear base frame unit 3 at two opposite sides to guide the movement of the pulley 543, the movable leg frame unit 5 can be stably moved up and down.

I claim:

1. An abdomen fitness equipment comprising a front base frame unit carrying a cushion, a substantially U-shaped handle having a middle section fixedly fastened to one end of said front base frame unit, a rear base frame unit pivoted to said front base frame unit, a rear movable frame unit pivoted to one end of said rear base frame unit and carrying a seat, and a movable leg frame unit pivoted to said rear base frame unit and capable of being pulled by a user's legs to lift said movable frame unit from said rear base frame unit, wherein:

said rear base frame unit comprises a transverse front end rod, a transverse rear end rod, a longitudinal rod connected between said transverse front end rod and said transverse rear end rod, a first pair of U-frames fixedly and bilaterally mounted on said transverse front end rod at a front side for pivotally connecting said front base frame unit, and a second pair of U-frames fixedly and bilaterally mounted on said transverse front end rod at a rear side for pivoted-connecting one end of said rear movable frame unit;

said rear movable frame unit comprises a substantially U-shaped frame rod having two opposite ends respectively pivoted to the second pair of U-frames of said rear base frame unit, two lugs fixedly secured to a middle section of said U-shaped frame rod for bilaterally pivoted connecting said movable leg frame unit;

said movable leg frame unit comprises a base frame rod, and an extension frame rod, the base frame rod of said rear movable leg frame unit being inserted through a gap defined between the seat of said movable frame unit and the middle section of said rear movable frame unit said base frame rod and pivotably connected between the lugs of said movable frame unit, having a locating hole at a bottom end and connected to said extension frame rod by a fastening device, said extension frame rod comprising a longitudinal series of locating holes at one end adapted for fastening to the locating hole of said base frame rod by said fastening device, and a pulley at an opposite end for moving along the longitudinal rod of said rear base frame unit, said pulley having two locating plates at two opposite sides adapted for guiding the movement of said pulley along the longitudinal rod of said rear base frame unit.

* * * * *